US007024014B1

(12) United States Patent
Noll

(10) Patent No.: US 7,024,014 B1
(45) Date of Patent: Apr. 4, 2006

(54) MULTIPLE VOICE-COIL CONE-DRIVER

(75) Inventor: Michael Noll, Columbus, IN (US)

(73) Assignee: Harman International Industries, Incorporated, Northridge, CA (US)

( * ) Notice: Subject to any disclaimer, the term of this patent is extended or adjusted under 35 U.S.C. 154(b) by 164 days.

(21) Appl. No.: 10/455,147

(22) Filed: Jun. 4, 2003

(51) Int. Cl.
*H04R 25/00* (2006.01)

(52) U.S. Cl. ..... 381/401; 381/402; 381/406

(58) Field of Classification Search ..... 381/400, 381/401, 402, 406, 117, 96
See application file for complete search history.

(56) References Cited

U.S. PATENT DOCUMENTS

| | | | | |
|---|---|---|---|---|
| 4,612,420 | A | 9/1986 | Nieuwendijk | |
| 6,175,637 | B1 * | 1/2001 | Fujihira et al. | 381/412 |
| 6,208,742 | B1 * | 3/2001 | Garcia et al. | 381/401 |

FOREIGN PATENT DOCUMENTS

| | | |
|---|---|---|
| EP | 0 137 549 B1 | 2/1987 |
| EP | 0 810 810 A2 | 3/1997 |

* cited by examiner

*Primary Examiner*—Huyen Le
*Assistant Examiner*—Tuan Duc Nguyen
(74) *Attorney, Agent, or Firm*—The Eclipse Group LLP

(57) ABSTRACT

A multiple voice-coil cone-driver for driving a loudspeaker includes a first voice-coil, and a second voice-coil coupled in parallel to the first voice-coil. Together, the first and second voice-coils in parallel are characterized by a baseline frequency response with an upper threshold frequency. In addition, at least one additional voice-coil (e.g., a third voice-coil) is coupled in parallel to the first and second voice-coils. The additional voice-coil(s), in conjunction with the first and second voice-coils, provide an enhanced frequency response in comparison to the baseline frequency response. One aspect of the enhanced frequency response is that it has an extended upper threshold frequency compared to the baseline frequency response, providing for more accurate reproduction of music and speech from a single speaker.

20 Claims, 5 Drawing Sheets

200

MULTIPLE VOICE-COIL CONE-DRIVER

BACKGROUND OF THE INVENTION

1. Field of the Invention

This invention relates generally to the field of loudspeakers. In particular, the invention relates to a multiple voice-coil cone-driver that may be incorporated into a loudspeaker.

2. Related Art

A loudspeaker typically includes a frame, a magnet assembly that provides a magnetic field across an air gap, a voice-coil, a former for supporting the voice-coil in the air gap, a diaphragm having an outer perimeter and an apex, and a surround coupled to the outer perimeter and the frame to support the outer perimeter from the frame. The voice-coil, supported by the former, is coupled to the apex of the diaphragm so that the current that flows through the voice-coil and causes the voice-coil to move in the air gap also causes the diaphragm to move.

In some settings, it is desirable to extend the upper threshold frequency (also known as "UTF") of a loudspeaker so that the loudspeaker may more accurately reproduce a wider range of frequency content in speech, music, and the like. At the same time, many applications demand that the loudspeaker remain small in package size. Traditionally, designers extended the upper threshold frequency by decreasing the moving mass (i.e., the physical structure that moves when the voice-coil is energized), increasing the cone depth, or adding an additional cone (e.g., tailored to high frequency response). Unfortunately, these approaches are not always suitable.

For example, decreasing the moving mass often entails lightening the diaphragm, which typically increases distortion. As another example, increasing the cone depth may place the loudspeaker outside of acceptable packaging depth requirements. These requirements may be particularly stringent in, for example, automobile applications.

Therefore, there is a need for extending the upper threshold frequency of a loudspeaker while overcoming the disadvantages associated with decreasing the moving mass, increasing the cone depth and/or adding an additional cone.

SUMMARY

A multiple voice-coil cone-driver that drives a loudspeaker cone in an improved manner is described. Structurally, the multiple voice-coil cone-driver may include a first voice-coil, and a second voice-coil coupled in parallel to the first voice-coil. Together, the first and second voice-coils in parallel are characterized by a baseline frequency response with an upper threshold frequency. In addition, at least one additional voice-coil (e.g., a third voice-coil) may be coupled in parallel to the first and second voice-coils. All of the voice-coils may be supported by a single voice-coil former.

The multiple voice-coil cone-driver may be constructed by a process that includes mounting a first voice-coil on a voice-coil former and mounting in parallel a second voice-coil on the voice-coil former. As a result, a baseline frequency response is established with an upper threshold frequency. The process may also include the steps of mounting a third voice-coil on the voice-coil former and coupling the third voice-coil in parallel to the first voice-coil. The third voice-coil, in conjunction with the first and second voice-coils, provides an enhanced frequency response that extends beyond the upper threshold frequency of the baseline frequency response.

The additional voice-coils, in conjunction with the first and second voice-coils, provide an overall frequency response that is an enhanced version of the baseline frequency response. One aspect of the overall frequency response is that it has an extended upper threshold frequency compared to the baseline frequency response. In other words, the overall frequency response is enhanced at high frequencies.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The components in the figures are not necessarily to scale, emphasis instead being placed upon illustrating the principles of the invention. In the figures, like reference numerals designate corresponding parts throughout the different views.

DETAILED DESCRIPTION

Figure 1:
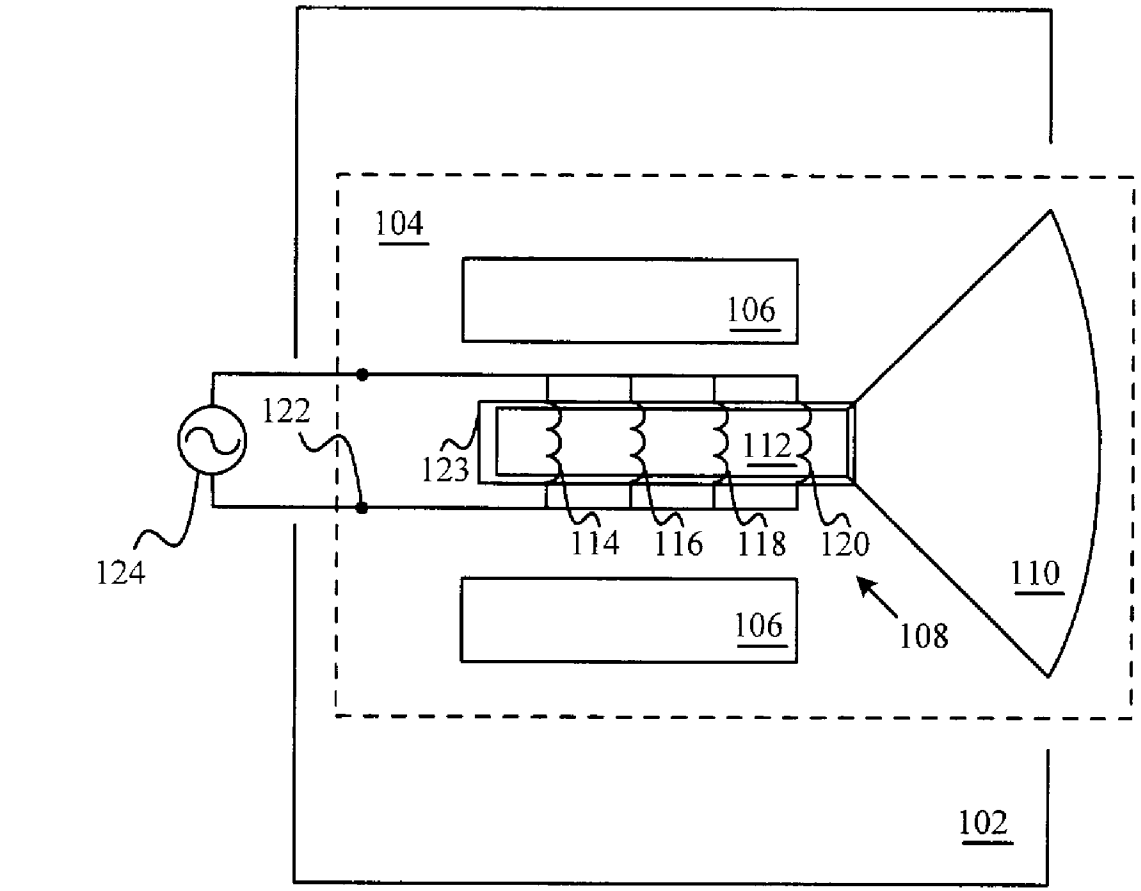
FIG. 1 shows an example implementation of a loudspeaker that includes a multiple voice-coil cone-driver.

In FIG. 1 an example implementation of a loudspeaker 100 is shown. The loudspeaker 100 may include an enclosure 102 that supports one or more speakers 104. The speaker 104 may include a magnet system 106 and a multiple voice-coil cone-driver (also referred to as a "cone-driver") 108 that is operatively connected to a loudspeaker cone 110.

More specifically, the cone-driver 108 may include a voice-coil former 112, a first, second, third, and fourth voice-coils 114, 116, 118, and 120, and a single source input 122. The voice-coils 114–120 may be wound on and glued to the voice-coil former 112. The voice-coils 114–120 are electrically connected (i.e., coupled) in parallel. There may be fewer (e.g., 3) voice-coils, or additional (e.g., 5) voice-coils. In addition, a protective collar 123 may be glued in place over both the combination of the former 112 and the voice-coils 114–120 and the loudspeaker cone 110.

The voice-coil former 112 itself may reside in a magnetic field gap defined by the magnet system 106. The loudspeaker cone 110, cone-driver 108, and magnet system 106 may take the form of a single cone assembly secured in place by a frame assembly (not shown) in the loudspeaker 100. An external signal source 124 is coupled to the source input 122 to drive the loudspeaker 100. The single source input 122 provides a connection point for a single source of external input signals (such as external signal source 124) to drive the loudspeaker 100. The single source input 122 may be implemented as wire leads, wire terminals, solder points for wires that connect to external jacks, and the like.

The voice-coils 114–120 extend the upper threshold frequency of the speaker 104 beyond the upper threshold frequency that would be exhibited if only the first and second voice-coils 114–116 were present. More specifically, taking the first voice-coil 114 and the second voice-coil 116 together, those two voice-coils exhibit a baseline frequency response. The baseline frequency response has an upper threshold frequency (UTF) at the frequency where the sound pressure level (SPL) falls 3 decibels (db) below its nominal value.

When the third voice-coil 118 is added, the overall frequency response (i.e., the frequency response of the voice-coils 114–118 in parallel) is enhanced in comparison to the baseline frequency response provided by the two voice-coils 114–116 alone. In particular, the enhanced frequency response has an upper threshold frequency that extends beyond the upper threshold frequency of the baseline frequency response. Thus, the speaker 104 may more accurately reproduce a wider range of speech, music, and/or other types of sounds. Similarly, when the fourth voice-coil 120 is added, the overall frequency response is enhanced yet again. That is, the new frequency response has an upper threshold frequency that extends even further beyond the upper threshold frequency of the baseline frequency response.

Figure 2:
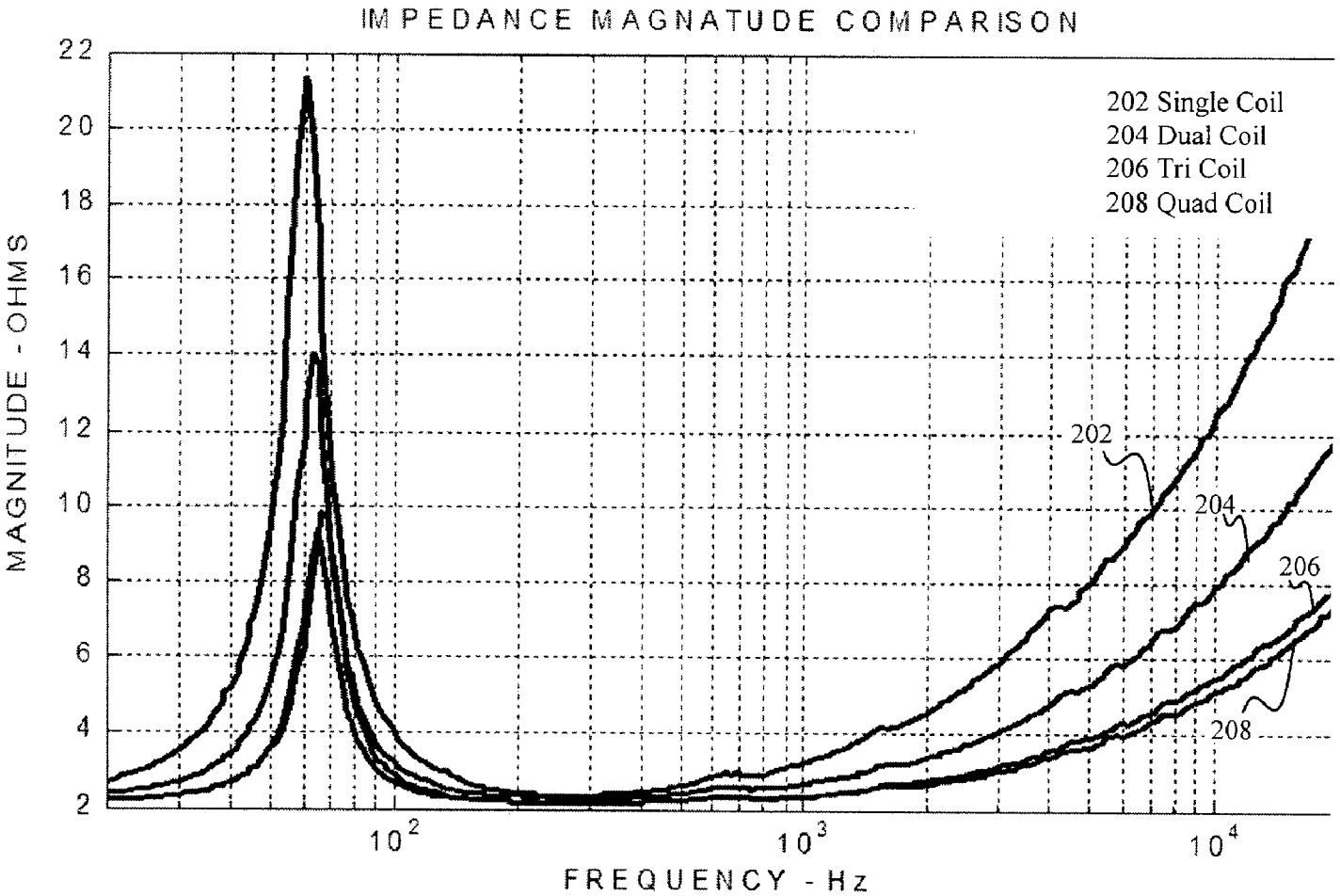
FIG. 2 shows an impedance plot comparing the frequency response of a single coil cone-driver and a dual coil cone-driver with tri and quad voice-coil cone-drivers.

FIG. 2 shows an impedance plot 200 of impedance in ohms versus frequency in Hertz (Hz). Plot 200 shows the effect on cone-driver 108 impedance magnitude assuming one, two, three, and four voice-coils. In FIG. 2, the impedance curve 202 shows the impedance magnitude of the cone-driver 108 when only the voice-coil 114 is present (the "single coil" design). The impedance curve 204 shows the impedance magnitude of the cone-driver 108 when the voice-coils 114 and 116 are present (the "dual coil" design). Similarly, the impedance curve 206 shows the impedance magnitude of the cone-driver 108 when the voice-coils 114–118 are present (the "tri coil" design). Finally, the impedance curve 208 shows the impedance magnitude of the cone-driver 108 when the voice-coils 114–120 are present (the "quad coil" design).

As shown in FIG. 2, after resonance (around 60 Hz) the impedance magnitudes drop, then start to rise again. However, the impedance magnitudes (particularly over the range of 20 to 20,000 Hz) of the tri coil and quad coil designs do not rise as quickly after approximately 1 KHz. The lower impedance magnitudes at higher frequencies yields an increase in SPL at those frequencies. Thus, the tri and quad coil designs provide an enhanced frequency response beyond the baseline frequency response given by the single or dual coil designs.

Figure 3:
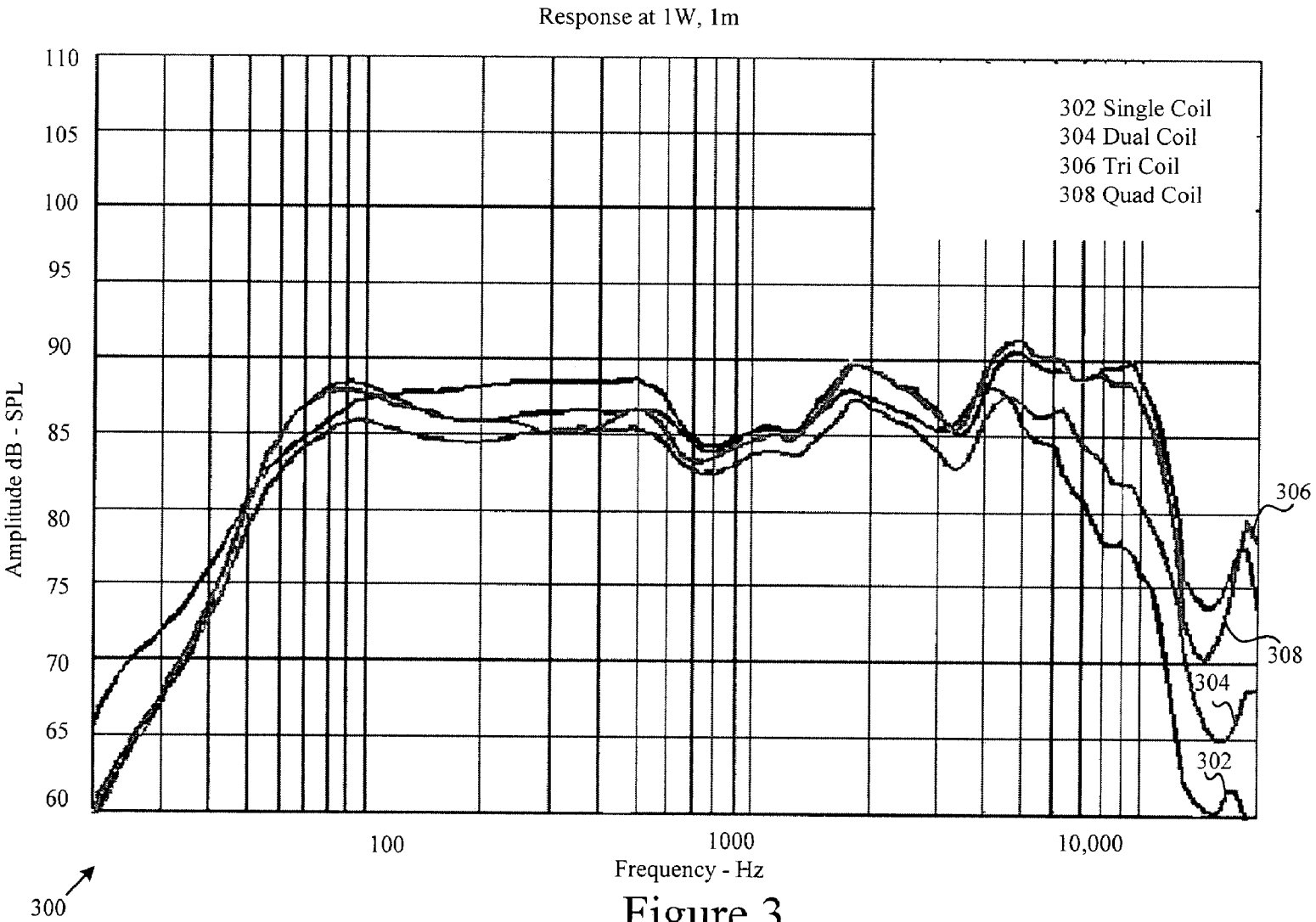
FIG. 3 shows a sound pressure level plot for a single, dual, tri, and quad voice-coil cone-drivers.

FIG. 3 shows an SPL plot 300 of SPL amplitude in decibels versus frequency for a cone-driver incorporating a single, dual, tri, or quad voice-coils. More particularly, the curve 302 shows the baseline frequency response for SPL of a single coil cone-driver. The curve 304 shows the baseline frequency response for SPL of a dual coil cone-driver. Similarly, the curve 306 shows an enhanced frequency response for SPL of a tri-coil cone-driver, while curve 308 shows an enhanced frequency response for SPL of a quad-coil cone-driver.

The upper threshold frequency or UTF is the frequency at which the SPL begins to roll off or diminish. It is generally regarded as the frequency where the SPL response is 3 db below its nominal value. For the physical constructions set forth below, the single coil design has an UTF of approximately 8,700 Hz, the dual coil design has an UTF of approximately 11,800 Hz, the tri coil design has an UTF of approximately 13,200 Hz, and the quad coil design has an UTF of approximately 12,900 Hz.

Figure 4:
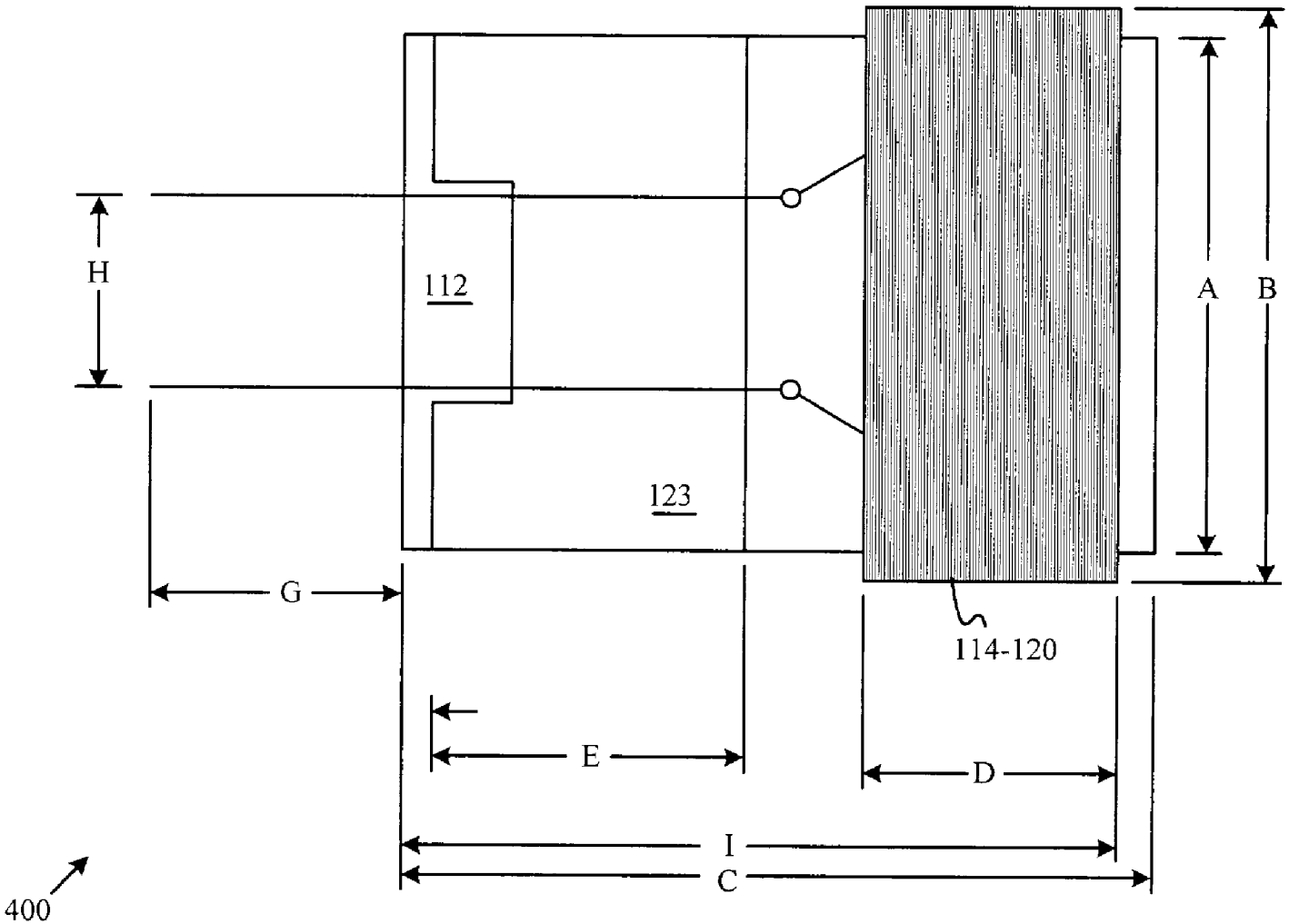
FIG. 4 shows an assembly drawing for an example implementation of a cone-driver as shown in FIG. 1.

The physical construction of the coils is described next in detail with reference to FIG. 4. The cone-driver 400 shown in FIG. 4 has the dimensions A–I, number of turns per voice-coil, DC resistance per coil (DCR), and wire type and size shown below in Table 1. Note that the DCR per coil increases when multiple voice-coils are employed in parallel in order to maintain a pre-selected overall DCR. For example, the DCR assuming a cone-driver with a single voice-coil is 2 ohms. When four voice-coils are employed, each has a DCR of 8 ohms, so that the four voice-coils in parallel result in an overall DCR of 2 ohms for the cone-driver.

TABLE 1

Dimensions in millimeters (mm), 0.25 mm tolerance unless otherwise noted

| | Single voice-coil | Dual voice-coil | Tri voice-coil | Quad voice-coil |
|---|---|---|---|---|
| A | 25.910 +– 0.030 | 25.910 +– 0.030 | 25.910 +– 0.030 | 25.910 +– 0.030 |
| B | 27.20 | 26.97 | 26.85 | 26.77 |
| C | 25.04 | 25.04 | 25.04 | 25.04 |
| D | 10.65 | 11.00 | 10.16 | 9.39 |
| E | 13.0 | 13.0 | 13.0 | 13.0 |
| F | 0.80 | 0.80 | 0.80 | 0.80 |
| G | 60.0 | 60.0 | 60.0 | 60.0 |
| H | 9.60 +– 2.50 | 9.60 +– 2.50 | 9.60 +– 2.50 | 9.60 +– 2.50 |
| I | 25.54 +– 0.50 | 25.54 +– 0.50 | 25.54 +– 0.50 | 25.54 +– 0.50 |
| Turns | 70 | 45 | 32 | 25 |
| Wire | Japan Industrial Standard (JIS) 25 | JIS20 | JIS17 | JIS15 |
| DCR | 2.0 ohms +– 0.15 | 4.0 ohms +– 0.15 | 6.0 ohms +– 0.15 | 8.0 ohms +– 0.15 |

The voice-coils 114–120 may be wound in multiple layers (e.g., two layers). Additionally, any of the voice-coils 114–120 may by wound in a BiFiler, TriFiler, or QuadFiler winding process in which multiple voice-coils are wound simultaneously. For example, using the TriFiler winding process, the three voice-coils 114–118 may be wound at the same time onto the former 112. As one example, a winding mandrel approximately 25.90 mm in diameter may be employed to wind the voice-coils, while a baking mandrel approximately 25.86 mm in diameter may be employed to bake cure the voice-coils (e.g., for 45 minutes at 375 degrees F.) after gluing. The former 112 may be made from 0.08 mm Kapton™ material, for example, while the collar 123 may be made from CeQuin™ material available from QUIN-T Corporation of Tilton, N.H.

Figure 5:
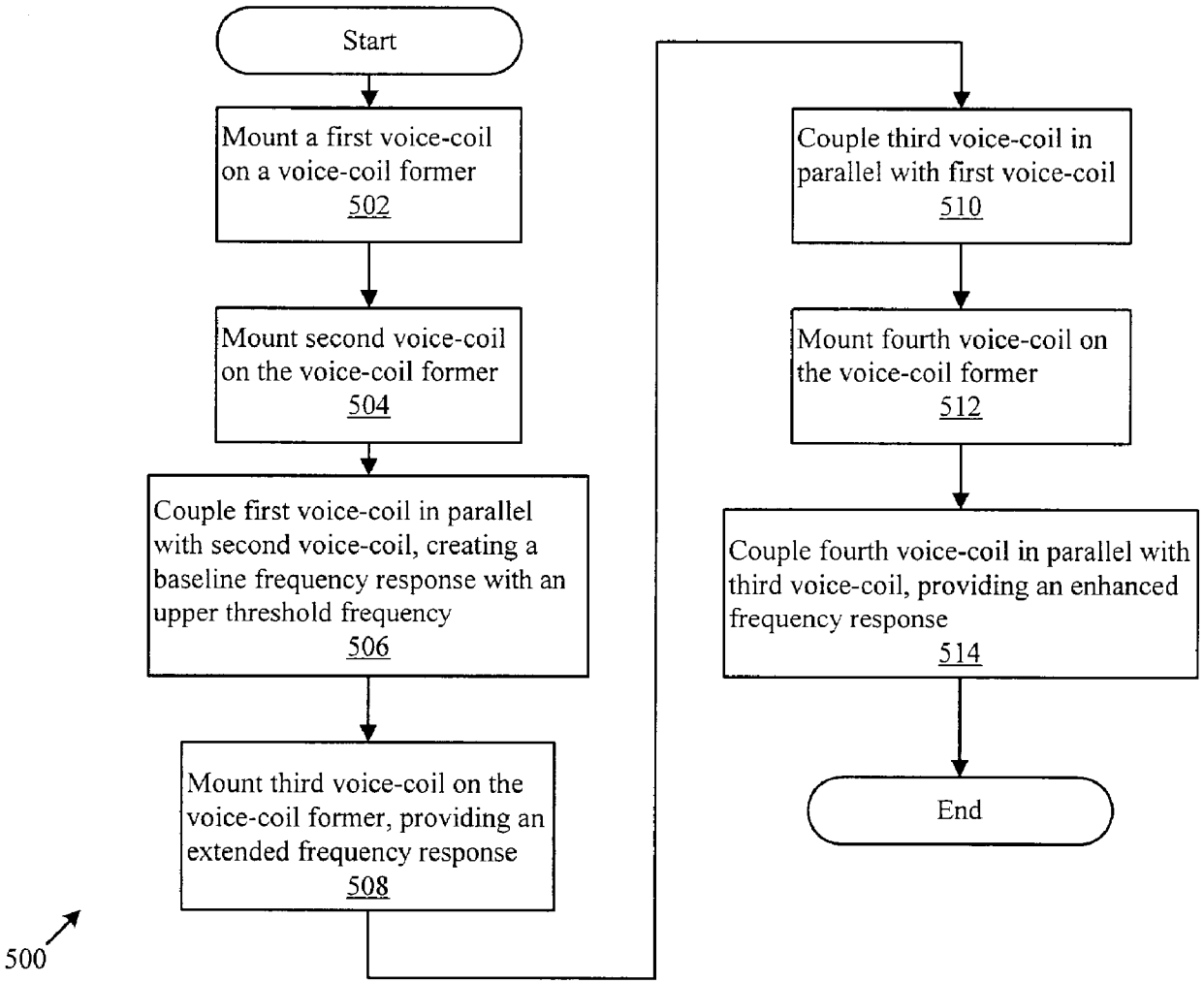
FIG. 5 shows an example process for fabricating the multiple voice-coil cone-driver shown in FIG. 1.

Turning next to FIG. 5, that figure summarizes an example process (i.e., method) for constructing or fabricating a voice-coil for driving the loudspeaker cone 110 shown in FIG. 1. The example method may include mounting a first voice-coil (for example, voice-coil 114) on a voice-coil former 112 (Step 502). Next, the method mounts a second voice-coil (for example, voice-coil 116) on the voice-coil former 112 (Step 504) and couples the first voice-coil 114 to the second-voice coil 116 (Step 506). As a result, as noted above, the first and second voice-coils 114–116 coupled in parallel provide a baseline frequency response with an upper threshold frequency.

Subsequently, the example method may also include mounting a third voice-coil (for example, voice-coil 118) on the voice-coil former 112 (Step 508). The third voice-coil 118 may be coupled in parallel to the first and second voice-coils 114–116, thereby providing an enhanced frequency response that extends beyond the upper threshold frequency of the baseline frequency response (Step 510). In a similar manner, a fourth voice-coil (for example, voice-coil 120) may be mounted on the voice-coil former 112 (Step 512) and coupled in parallel to the first voice coil 114, resulting in an further enhanced frequency response (Step 514). Therefore, the voice-coils 114–120 may be mounted by winding them onto the voice-coil former 112. As examples, the voice-coils 114–120 may be individually wound and soldered or otherwise coupled together, or they may be simultaneously wound using a BiFiler, TriFiler, or QuadFiler winding process.

In summary, either or both of the voice-coils 118–120 may be employed to extend the upper threshold frequency of the speaker 104 beyond what would be exhibited if only the first and second voice-coils 114–116 were present. The extension in upper threshold frequency allows the speaker 104 to more accurately reproduce a wider range of speech, music, and/or other sounds.

While various embodiments of the invention have been described, it will be apparent to those of ordinary skill in the art that many more embodiments and implementations are possible that are within the scope of this invention.

What is claimed is:

1. A multiple voice-coil cone-driver for driving a loudspeaker cone, the multiple voice-coil cone-driver comprising:

a first voice-coil;

a second voice-coil coupled in parallel to the first voice-coil, the first and second voice-coils in parallel characterized by a baseline frequency response with an upper threshold frequency;

a third voice-coil coupled in parallel to the second voice-coil, the third voice-coil, in conjunction with the first and second voice-coils, providing an enhanced frequency response that extends beyond the upper threshold frequency of the baseline frequency response; and a voice-coil former supporting at least one of the first, second, and third voice-coils.

2. The multiple voice-coil cone-driver of claim 1, further including a fourth voice-coil coupled in parallel with the third voice-coil, the third and fourth voice coils, in conjunction with the first and second voice-coils, providing the enhanced frequency response.

3. The multiple voice-coil cone-driver of claim 1, where the enhanced frequency response extends the upper threshold frequency of the first frequency response by at least 500 Hz.

4. The multiple voice-coil cone-driver of claim 1, where the enhanced frequency response extends the upper threshold frequency of the first frequency response by at least 1000 Hz.

5. The multiple voice-coil cone-driver of claim 1, where at least two of the voice-coils are simultaneously wound voice-coils.

6. The multiple voice-coil cone-driver of claim 1, where the enhanced frequency response includes a lower impedance magnitude beyond the upper threshold frequency than the baseline frequency response.

7. The multiple voice-coil cone-driver of claim 2, where the enhanced frequency response includes a lower impedance magnitude beyond the upper threshold frequency than the baseline frequency response.

8. The multiple voice-coil cone-driver of claim 1, further including a protective collar over the voice-coil former.

9. A loudspeaker comprising:

a loudspeaker enclosure;

a magnet system in the enclosure;

a loudspeaker cone; and a cone-driver connected to the loudspeaker cone and the magnet system, the cone-driver including:

a first voice-coil;

a second voice-coil coupled in parallel to the first voice-coil, the first and second voice-coils in parallel characterized by a baseline frequency response with an upper threshold frequency;

a third voice-coil coupled in parallel to the second voice-coil, the third voice-coil, in conjunction with the first and second voice-coils, providing an enhanced frequency response that extends beyond the upper threshold frequency of the baseline frequency response; and a voice-coil former supporting at least one of the first, second, and third voice-coils.

10. The loudspeaker of claim 9, further including a fourth voice-coil coupled in parallel with the third voice-coil, the third and fourth voice-coils, in conjunction with the first and second voice-coils, providing the enhanced frequency response.

11. The loudspeaker of claim 9, where the enhanced frequency response extends the upper threshold frequency of the first frequency response by at least 500 Hz.

12. The loudspeaker of claim 9, where the enhanced frequency response extends the upper threshold frequency of the first frequency response by at least 1000 Hz.

13. The loudspeaker of claim 9, where at least two of the voice-coils are multiply wound voice-coils.

14. The loudspeaker of claim 9, where the enhanced frequency response comprises a lower impedance magnitude beyond the upper threshold frequency than the baseline frequency response.

15. The loudspeaker of claim 9, further including a protective collar over the voice-coil former.

16. A multiple voice-coil cone-driver for driving a loudspeaker cone, the multiple voice-coil cone-driver comprising:

a first voice-coil;

a second voice-coil coupled in parallel to the first voice-coil, the first and second voice-coils in parallel characterized by a baseline frequency response with an upper threshold frequency;

means for providing an enhanced frequency response for the cone-driver that extends beyond the upper threshold frequency of the baseline frequency response;

a voice-coil former supporting at least one of the first and second voice-coils; and a single source input coupled to the first voice-coil for accepting signal input from a single source.

17. The multiple voice-coil cone-driver of claim 16, where the enhanced frequency response extends the upper threshold frequency of the first frequency response by at least 500 Hz.

18. The multiple voice-coil cone-driver of claim 16, where the enhanced frequency response extends the upper threshold frequency of the first frequency response by at least 1000 Hz.

19. The multiple voice-coil cone-driver of claim 16, further including a protective collar over the voice-coil former.

20. The multiple voice-coil cone-driver of claim 16, where the first and second voice-coils in parallel are characterized by a predetermined impedance magnitude at the upper threshold frequency, and where the means for providing an enhanced frequency response provides a lower impedance magnitude than the predetermined impedance magnitude at the upper threshold frequency.

* * * * *